US005125512A

United States Patent [19]

O'Leary

[11] Patent Number: 5,125,512

[45] Date of Patent: Jun. 30, 1992

[54] NESTABLE CUP WITH ALTERNATIVE CLOSURE STRUCTURE

[75] Inventor: Arthur J. O'Leary, County of St. Louis, Mo.

[73] Assignee: Northwestern Bottle Co., St. Louis, Mo.

[21] Appl. No.: 669,769

[22] Filed: Mar. 15, 1991

[51] Int. Cl.[5] ..... B65D 1/16

[52] U.S. Cl. ..... 206/517; 206/519; 229/153; 220/673

[58] Field of Search ..... 206/517, 518, 519; 220/675, 673, 669, 212; 215/10; 229/1.5 B

[56] References Cited

U.S. PATENT DOCUMENTS

| | | | |
|---|---|---|---|
| 3,045,887 | 7/1962 | Crane | 220/675 |
| 3,653,575 | 4/1972 | Schrepper | 206/520 |
| 4,124,120 | 11/1978 | Day | 206/519 |
| 4,548,348 | 10/1985 | Clements | 206/514 |
| 4,660,734 | 4/1987 | Heaney et al. | 206/519 |
| 4,815,783 | 3/1989 | Montreuil et al. | 220/212 |
| 4,877,142 | 10/1989 | Doering | 215/10 |
| 5,040,682 | 8/1991 | Palisin, Jr. et al. | 206/519 |

*Primary Examiner*—Stephen Marcus
*Assistant Examiner*—Christopher McDonald
*Attorney, Agent, or Firm*—Polster, Lieder, Woodruff & Lucchesi

[57] ABSTRACT

An article of manufacture comprising an integrally molded plastic cup nestable with indentically formed plastic cups. The mouth of the cup is formed with a threaded portion and a circumferential lip portion therebeneath. The threaded portion may be matingly engaged with a threaded cap, or if desired, the threaded portion may be removed and the lip portion may be matingly engaged with a snap-on cap. Thus a cup with two alternative types of closure means may be manufactured from a single mold and a single inventory can be kept for orders of either type of closure. Air passage means are formed in a surface of the cup wall to permit air to flow therethrough when identical cups are nested thereby preventing difficulty in removing one cup from another due to air pressure differentials inside the nested cups created during storage temperature differentials and during separation of nested cups.

10 Claims, 2 Drawing Sheets

NESTABLE CUP WITH ALTERNATIVE CLOSURE STRUCTURE

BACKGROUND OF THE INVENTION

Plastic cups have been manufactured in a mold with a threaded mouth for mating engagement with a threaded cap. It is also known to manufacture in a separately constructed mold a plastic cup having a circumferential lip or tab around the mouth for mating engagement with a plastic snap-on cap. In order to create these two differently closed cups, it has been necessary to create two different molds, each of which are quite expensive to fabricate. Further, in order to quickly satisfy orders for both types of cups, it has been necessary to maintain large inventories of each of the different types of cups, since it would not be known when a large order for one or the other type cup would be made.

It has also been known that plastic cups may be formed with an outward taper toward the top to allow identical cups to be nested at least partially one within the other to reduce the space required during warehousing and shipping and to provide a convenient stack of cups at the point of use. It has been a problem with such nested cups that an air seal may develop between the touching surfaces of adjacently stacked cups such that a reduced air pressure is created within the cup as it begins to be removed from the adjacent cup. This reduced air pressure causes adjacent cups to stick together making separation and removal of a cup from the stack difficult and inconvenient. This problem is especially significant in a fast moving vending situation such as in a fast food establishment or an amusement park or fair grounds vending booth. That is to say, vendors in such places want cups that do not stick together so that peak customer demands can be accomodated without interruption and delay. Pressure differentials also may exist when the air between stacked cups is chilled after nesting, again creating difficulty in separating stacked cups.

SUMMARY OF THE INVENTION

An object of the invention is to provide an article of manufacture from a single mold which may be utilized as a cup with a threaded mouth for mating engagement with a threaded cap, or alternatively, which may be utilized, by simple modification, as a cup with a lipped mouth for mating engagement with a snap-on cap.

It is another object of the invention to provide a cup, nestable with identically formed cups, which will not produce an air seal between adjacent cups, and thus will not stick together due to air pressure differentials.

It is a still further object of the invention to provide air passage means on the exterior surface of a nestable cup which are aesthetically pleasing and which will act as a non-slip finger grip area.

It is still another object of the invention to provide a method of manufacturing plastic cups having a threaded mouth for engagement with a threaded cap and cups having a lipped mouth for engagement with a snap-on cap from the same mold.

The present invention provides for an integrally molded cup, preferably blow-molded plastic, having a generally horizontal bottom, an upstanding wall and an open top mouth. A generally cylindrical upstanding threaded portion is formed around the mouth. A radially extending lip portion, preferably extending circumferentially around the cup, is formed beneath the threaded portion. The cup may be used in this form for mating engagement with a threaded cap closure. If desired, the threaded portion may be removed to expose the lip portion to the open top mouth, and the cup may then be used for mating engagement with a snap-on cap closure.

The cups are formed to include a generally radially outward taper toward the top thereof to allow identically formed cups to nest one with another. At least at the point of contact between nested cups there is provided air passage indentations, preferably on the interior and exterior of the side wall to permit the passage of air and the equalization of air pressure between the environment and the space formed between nested cups. The air passage indentations are formed such that they can never matingly seal between the contact area of nested cups and such that they form a convenient non-slip finger grip area for the user. Thus nested cups will always separate in a facile manner with minimal sticking of one within another.

These, as well as other objects and advantages of the present invention will become more apparent upon a reading of the following detailed description of a preferred embodiment.

DETAILED DESCRIPTION OF A PREFERRED EMBODIMENT

Figure 1A:
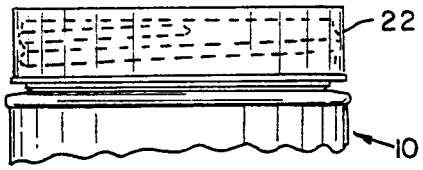
FIG. 1A is a side elevation view of the top portion only of the cup of FIG. 1 with a threaded cup closure thereon.
Figure 1:
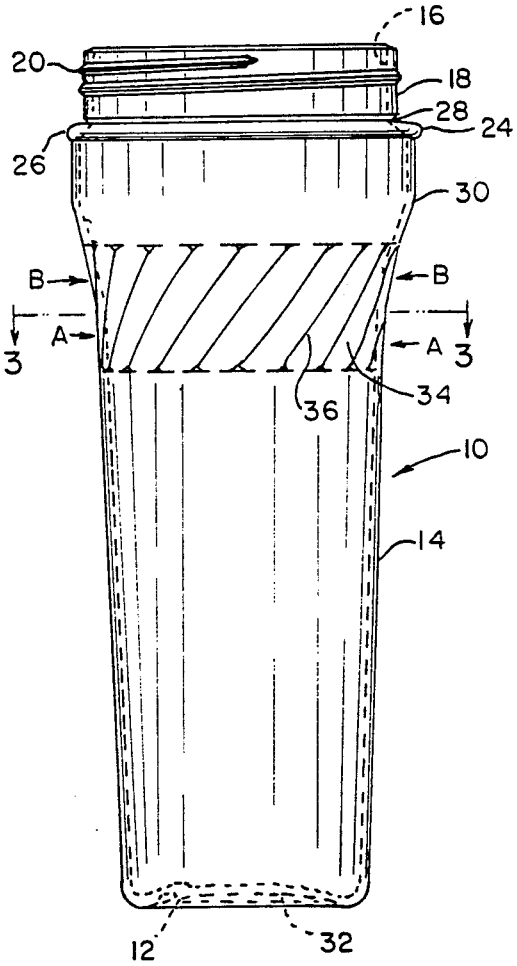
FIG. 1 is a side elevation view of the preferred embodiment of the present invention showing a molded cup having a threaded top.

With reference to the drawings and FIG. 1 in particular, there is shown one illustrative embodiment for an article of manufacture in the form of a drinking cup generally referred to by the numeral 10. Cup 10 is blow-molded in a well known manner in a molding apparatus utilizing any of the well known plastic materials used to make integrally molded drinking cups. Cup 10 includes a generally horizontal bottom 12, an upstanding side wall 14 and an open top circular mouth 16. Formed around mouth 16 is a generally cylindrical upstanding threaded portion 18 having external helical threads 20 for mating engagement with a generally cylindrical internally threaded cap closure 22 (FIG. 1A).

Beneath threaded portion 18 there is formed a lip projection portion 24 having an annular radially outwardly extending lip 26. Between threaded portion 18 and lip projection portion 24 is an annular inwardly directed groove 28. Beneath lip projection portion 24, side wall 14 of cup 10 begins to taper radially inwardly at the point indicated by numeral 30 in the downward direction. Side wall 14 begins to taper radially inwardly at a much smaller angle at the point of section line 3—3 and extends downwardly at this small angle of taper until it meets with bottom 12. Bottom 12 includes a central curved upward recess 32 as is well known in the art.

Figure 3:
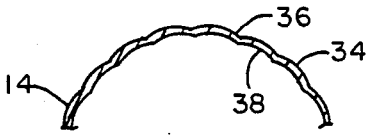
FIG. 3 is a partial cross-section view of the cup of FIG. 1 taken along line 3—3 of FIG. 1.

While the greatest extent of side wall 14 of cup 10 is generally smooth, both on the inside and outside surfaces thereof, there is molded into the interior and exterior surfaces of side wall 14 a series of circumferential spaced convolutions 34. Convolutions 34 form indentations 36 therebetween on the exterior surface of side wall 14, and form indentations 38 (FIG. 3) on the interior surface of side wall 14. Indentations 36 and 38 extend in a generally helical manner for a short distance around the central vertical axis of cup 10.

Figure 4:
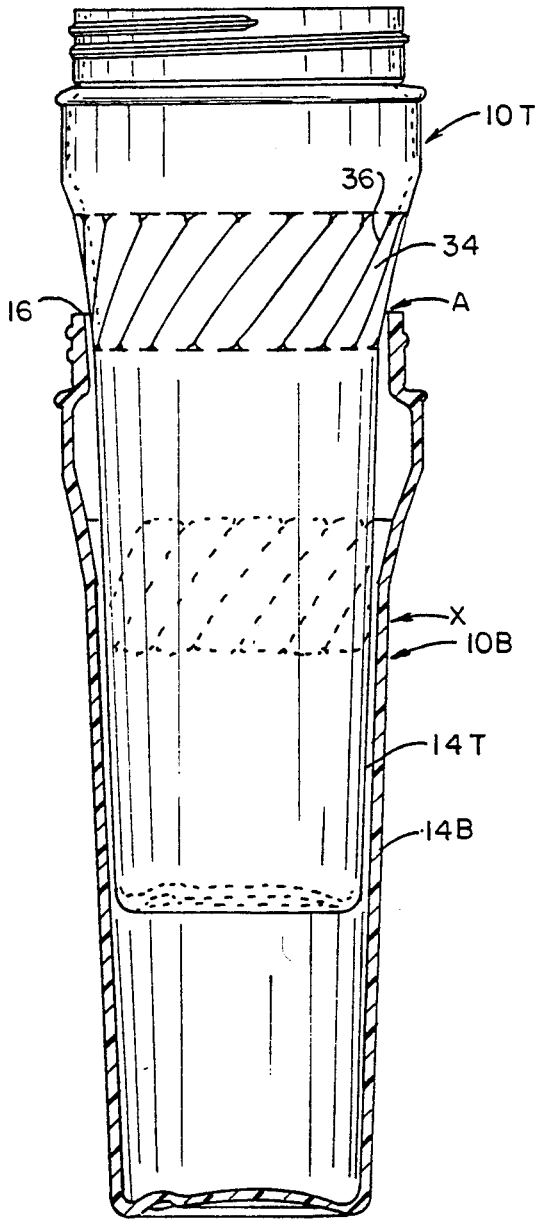
FIG. 4 is a side view of two nested cups, each configured the same as the cup of FIG. 1, with the top cup shown in elevation and the bottom cup shown in cross-section.

Cup 10 is formed such that it will nest with another identically formed cup. It is important that external indentations 36 and/or internal indentations 38 extend longitudinally on each interior and exterior surface through the point or points of contact between two nested cups for reasons which will be explained hereinafter. It is noted that the point of contact between two nested cups of the preferred embodiment shown in FIG. 1 will be at the level of the arrows indicated by the letter A. That is, the external diameter of convolutions 34 at level A will be equal to the internal diameter of mouth 16 at threaded portion 18. As best seen in FIG. 4, if two identical cups 10T and 10B are nested one within the other, external convolutions 34 of the top cup 10T will meet with mouth 16 at point A. Since indentations 36 are of relatively reduced diameter, indentations 36 will act as air passageways between the exterior environment and the interior chamber formed between top cup 10T and bottom cup 10B.

In the preferred embodiment, nested cups 10T and 10B meet circumferentially only at point A, however, it should be noted that if the exterior of wall 14T of cup 10T should instead meet with the interior of wall 14B at, for example, the level indicated by arrow X, then it is important that interior indentations 38 extend longitudinally on both sides of and through contact point X to provide air passages to the bottom interior of cup 10B. It is contemplated that cups 10T and 10B may be formed to include both points of contact A and X so that both external indentations 36 and internal indentations 38 are available for the passage of air and the resulting air pressure equalization between the environment and the bottom interior of bottom cup 10B.

It can be seen that when indentations 36 and/or 38 are placed properly on cup 10 with consideration given to the particular shape and taper of side wall 14 of cup 10, air passages are formed such that the air pressure within nested cups will always equalize with the outside air pressure even as one cup is being removed from the interior of another cup. Thus, nested cups will always separate in a facile manner with minimal sticking of one within the other, which would otherwise not be the case due to interior air pressure being less than that of the external environment.

Figure 2A:
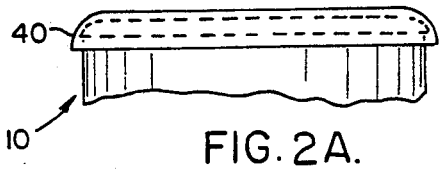
FIG. 2A is a side elevation view of the top portion only of the cap of FIG. 2 with a "Frisby-type" snap-on cap closure thereon.
Figure 2:
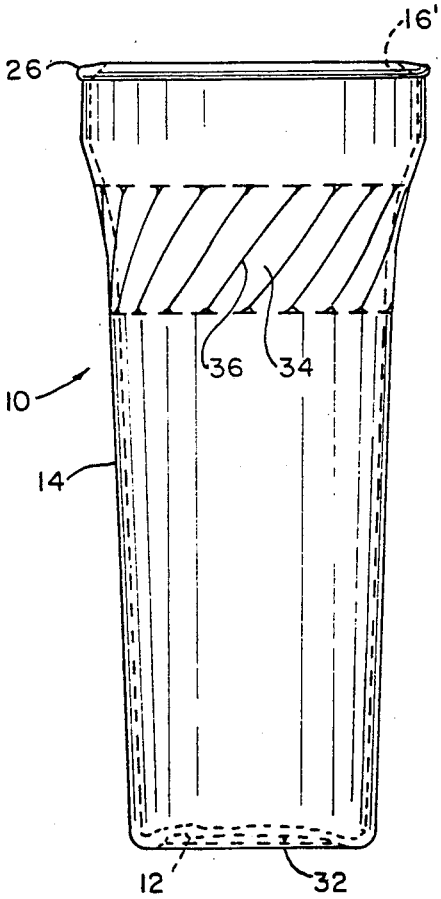
FIG. 2 is a side elevation view of the cup of FIG. 1 with the threaded portion of the top removed to reveal an annular tab top.

It is contemplated that a large quantity of the cup shown in FIG. 1 could be manufactured and kept in inventory awaiting orders for same. However, orders for a nestable cup may be received for a cup utilizing a snap-on closure rather than a threaded cap closure. It is desirable that it not be necessary to produce and store large inventories of the snap-on cap type cup also. Therefore, according to the principles of the present invention, when an order for snap-on cap cups is received it can be quickly filled by removing the threaded top portion 18 of cup 10 for example, by means of a high-speed machine utilizing a high speed saw cutting across the bottom of threaded portion 18 along groove 28. As shown in FIG. 2, cup 10 will then be formed with a circular open mouth 16' having annular external tab 26 therearound. Tab 26 is formed to matingly engage a "Frisby-type" snap-on plastic cap 40 (FIG. 2A).

Figure 5:
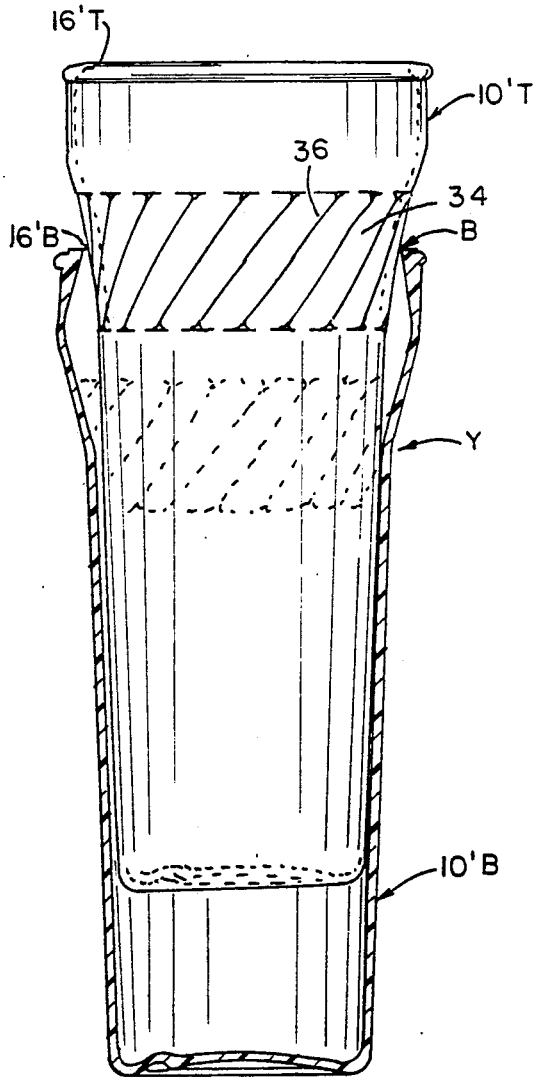
FIG. 5 is a side view of two nested cups, each configured the same as the cup of FIG. 2, with the top cup shown in elevation and the bottom cup shown in cross-section.

FIG. 5 shows two identical nested cups according to the modified configuration of cup 10'. Top nested cup 10'T meets with the mouth of bottom cup 10'B at the level of point B. Point B is slightly higher than point A as shown in FIG. 1. This is due to the fact that the diameter of open mouth 16' is slightly larger than the diameter of mouth 16 and the external diameter of cup 10 is greater at point B than at point A. Again it is noted that according to the preferred embodiment, nested cups will meet around the circumference thereof only at the mouth of the cup and convolutions 34 must run through this point; however, if nested cups do meet either solely at the interior point Y (FIG. 5), for example, then it is important that interior indentations 38 run longitudinally through that point.

The helical configuration of convolutions 34 provide the additional benefits of a non-slip finger grip surface and an aesthetically pleasing design.

It can thus be seen that the preferred embodiment described hereinabove and formed according to the principles of the present invention provides for the objects and advantages enumerated herein. It is noted, however, that numerous modifications may be made to the article of manufacture of the preferred embodiment without departing from the spirit and scope of the invention. For example, lip projection 26 need not extend completely around mouth 16' and may only include circumferentially spaced projections. Also, projection portion 24 may include a radially inwardly directed lip projection for mating engagement with a circumferentially grooved snap-on cap. The scope of the invention which is to be ascertained solely by the language of the following claims as interpreted in light of the disclosure and the doctrine of equivalents.

What is claimed is:

1. An article of manufacture comprising an integrally molded cup having a generally horizontal bottom, upstanding side wall means and an open top mouth;

a generally cylindrical upstanding threaded portion around said mouth having threads thereon for mating engagement with a first cup closure;

a radially extending lip portion formed beneath said threaded portion for mating engagement with a second cup closure, such that said threaded portion may be utilized as the cup closure engagement means or may be removed to thereafter permit the lip portion to be the cup closure engagement means, thereby allowing a single integrally molded cup to be alternatively formed into a lip closure cup or a threaded closure cup.

2. The article of manufacture as specified in claim 1 wherein:

said side wall means includes an inside surface and an outside surface, and a generally radially outward taper towards the top thereof;

said cup being nestable with another identical cup; and said cup including air passage means, on at least one of said inside and outside surfaces of said wall means at least at a point of contact with another nested identical cup, for the passage of air through said air passage means when said cup is nested with another identical cup.

3. The article of manufacture as specified in claim 2 wherein:

said air passage means include a plurality of circumferentially spaced indentations in at least one of said inside and outside surfaces of said wall means.

4. The article of manufacture as specified in claim 3 wherein:

said plurality of circumferentially spaced indentations are parallel, generally helically extending indentations.

5. The article of manufacture as specified in claim 4 wherein:

said indentations are on said outside surface such that the area of said indentations act as a non-slip finger grip area.

6. The article of manufacture as specified in claim 1 wherein:

said lip portion extends radially outwardly beneath said threaded portion.

7. The article of manufacture as specified in claim 6 wherein:

said lip portion extends circumferentially around said cup.

8. A nestable molded plastic cup comprising an integrally molded plastic cup member having a bottom and a side wall means extending from said bottom and terminating at an open mouth opposite said bottom;

said side wall means having an inside and an outside surface;

said side wall means including air passage means on at least one of said inside and said outside surfaces, for the passage of air through said air passage means when said plastic cup member is nested with another identically formed plastic cup member;

a generally cylindrical upstanding threaded portion formed around said mouth having threads thereon for mating engagement with a first cup closure;

a radially extending lip portion formed adjacent said threaded portion for mating engagement with a second cup closure, such that said threaded portion may be utilized as the cup closure engagement means or alternatively the lip portion may be utilized as the cup closure engagement means.

9. A nestable molded cup comprising:

an integrally molded cup member having a bottom;

side wall means extending from said bottom, said side wall means having an inside surface and an outside surface, said side wall means terminating at an open mouth opposite said bottom, said side wall means including a generally radially outward taper towards the top thereof;

air passage means formed on at least one of said inside and said outside surfaces of said side wall means for the passage of air through said air passage mean when said cup member is nested within another identically formed cup member, said air passage means being located at least at a point of contact with another identically formed nested cup, said air passage means including a plurality of circumferentially spaced indentations in at least one of the inside and outside said surfaces of said side wall means, said plurality of circumferentially spaced indentations being parallel, generally helically extending indentations.

10. The nestable cup as specified in claim 9 wherein said indentations are on said outside surface such that the area of said indentations acts as a non-slip finger grip area.

* * * * *